United States Patent [19]

Uchida

[11] Patent Number: 4,672,927

[45] Date of Patent: Jun. 16, 1987

[54] VALVE ACTUATOR FOR INTERNAL COMBUSTION ENGINE

[75] Inventor: Takanao Uchida, Saitama, Japan

[73] Assignee: Honda Giken Kogyo Kabushiki Kaisha, Tokyo, Japan

[21] Appl. No.: 749,553

[22] Filed: Jun. 27, 1985

[30] Foreign Application Priority Data

Jun. 29, 1984 [JP] Japan ..... 59-134832

[51] Int. Cl.[4] ..... F01L 1/18

[52] U.S. Cl. ..... 123/90.44; 123/90.27; 123/90.39

[58] Field of Search ..... 123/90.44, 90.27, 90.39

[56] References Cited

U.S. PATENT DOCUMENTS

| | | | |
|---|---|---|---|
| 3,002,507 | 10/1961 | Bensinger et al. | 123/90.44 |
| 3,166,058 | 1/1965 | Zink | 123/90.44 |
| 3,563,216 | 2/1971 | Uemura | 123/90.44 |
| 4,359,019 | 11/1982 | Gaede | 123/90.44 |
| 4,369,740 | 1/1983 | Seidl | 123/90.44 |
| 4,418,659 | 12/1983 | Gaede | 123/90.44 |
| 4,539,952 | 9/1985 | Nouno et al. | 123/90.36 |

FOREIGN PATENT DOCUMENTS

| | | | |
|---|---|---|---|
| 195808 | 12/1982 | Japan | 123/90.44 |
| 96111 | 6/1983 | Japan | 123/90.44 |
| 96112 | 6/1983 | Japan | 123/90.44 |

*Primary Examiner*—Ira S. Lazarus

*Attorney, Agent, or Firm*—Lyon & Lyon

[57] ABSTRACT

A valve actuating mechanism for an overhead valve and overhead cam type internal combustion engine in which the camshaft is positioned above and between the valve and a cam follower seat member in the cylinder head. The cam follower has downwardly facing portions on each end for engaging the valve and seat number and an upwardly facing slipper face for engaging the cam on the camshaft for causing rocking or pivoting motion of the cam follower. The shape of the slipper face is formed to engage the cam at the start of the valve-lifting movement of the cam follower to minimize the lateral forces on the cam follower which otherwise would tend to cause shifting of the cam follower and resultant noise and wear.

2 Claims, 4 Drawing Figures

VALVE ACTUATOR FOR INTERNAL COMBUSTION ENGINE

The present invention relates to the valve actuating mechanism for an overhead valve type internal combustion engine and, in particular, to the shape and arrangement of a cam follower of the type which has one end pivotally supported on a seat member and the other end engaging the end of the valve stem with the cam shaft positioned above the cam follower and between the two ends to cause pivoting of the cam follower to actuate the valve.

In this type of valve actuating mechanism, the cam follower is not rotationally supported by any shaft or arm but rather has a ball shaped end that loosely fits in a semispherical socket on the seat member and is held in position merely by the three points of engagement, namely, the seat member, the valve stem and the cam. In a typical prior art arrangement of this type of valve mechanism, as shown in FIG. 4 of the drawings, the slipper face 12*a*′ on the cam follower 12′ is engaged by the cam 13*a* of the cam shaft 13 at a contact point A′ as the camshaft 13 rotates in the direction of arrow 16 to start the lifting of the valve such that a tangent line $L_3$, through the point A′ is at an angle to a second line $L_4$ extending between the contact point B between the cam follower and the seat member 11 and the the contact point C between the cam follower and the valve stem 7. As a result of this angular relationship, the force F perpendicular to the tangent $L_3$, at the contact point A′ produces a valve lifting force component $F_1$ perpendicular to the line $L_4$ (i.e., the effective pivot line) and a lateral force component $F_2$, parallel to the line $L_4$. This lateral force component $F_2$, tends to urge the cam follower 12′ laterally which is possible by reason of the loose fit between the ball and socket recess 11*a* of the seat member that is necessary for the normal pivoting. This lateral shifting of the cam follower 12′ produces noise and may increase the wear.

Thus, it is an object of the present invention to provide a valve actuating mechanism wherein the components are arranged and shaped for the cam to produce a force on the cam follower at the start of the valve lifting movement that is in a direction relative to the line connecting the points of contact of the cam follower with the seat member and the valve stem whereby there is no resultant lateral force component tending to cause shifting of the cam follower and undesirable noise and wear.

Two embodiments of the present invention are shown in the drawings, as follows.

Figure 1:
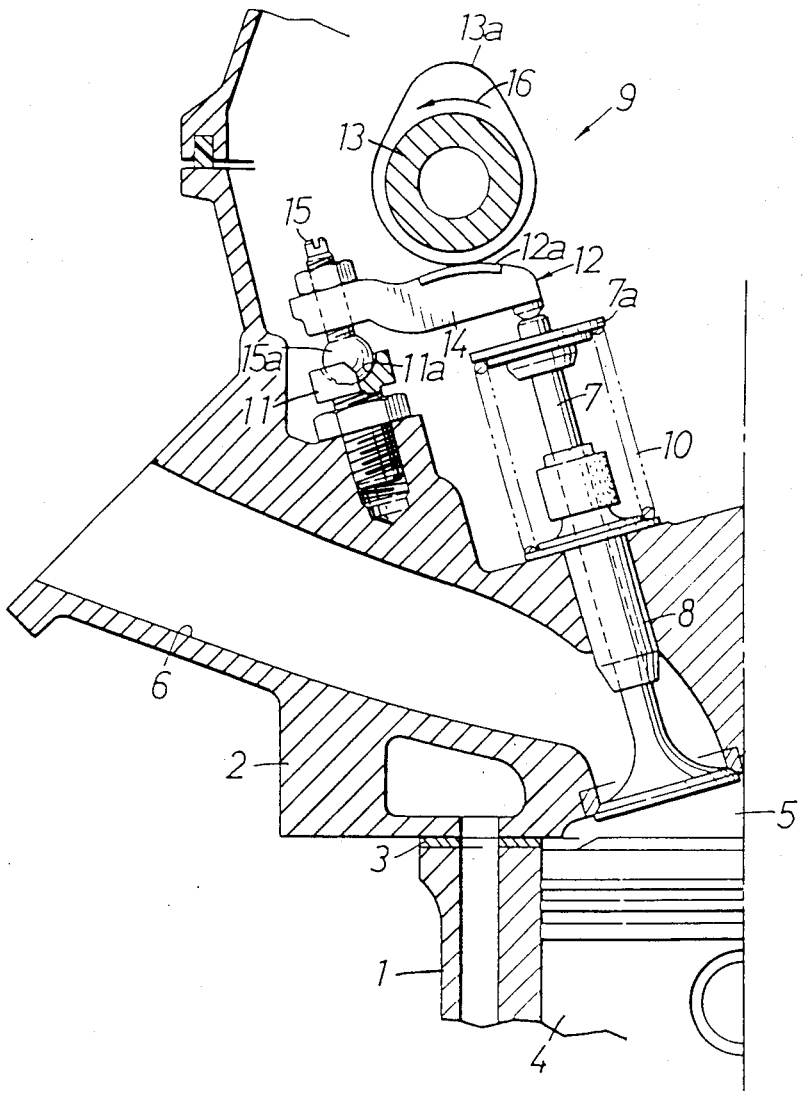
FIG. 1 is a sectional elevation view of an overhead valve and cam mechanism of an internal combustion engine employing the valve actuating mechanism of this invention.

Referring now to FIG. 1, the internal combustion engine includes a cylinder block 1 on which a cylinder head 2 is mounted with a gasket 3 positioned therebetween for a sealing relationship. The engine may include a plurality of cylinders with similar valve actuating mechanisms on both sides of the cylinder for the intake and exhaust valves but for convenience and simplicity of illustration and description, only the intake valve side and actuating mechanism for a single cylinder will be described. The cylinder head 2 is formed with a combustion chamber 5 facing a piston 4 in the cylinder block 1. An intake port 6 opens into the combustion chamber 5 and an intake valve 7 is adapted to open and close the port 6 during operation of the engine. The valve 7 is slidably supported in valve guide 8 mounted in the cylinder head 2 for reciprocating movement. The valve 7 is resiliently held in its upward closed position by a compression type valve spring 10 extending between the cylinder head 2 and a retainer 7*a* mounted on the upper end of the valve 7.

A valve actuating mechanism, generally designated 9, includes a cam follower 12 having one end supported on a seat member 11, the other end supported on the end of the valve 7 and engaged by a cam 13*a* on a camshaft 13 which is rotatably supported in the cylinder head 2 and rotated in a conventional manner, not shown. The seat member 11 is threadedly mounted in the cylinder head 2 and is locked in the desired position. That end of the cam follower 12 is provided with an adjustable bolt 15 threadedly received in the arm portion 14 of the cam follower for adjusting the valve actuating mechanism. The bolt 15 has a spherical fulcrum 15*a* adapted to engage the semispherical recess 11*a* in the seat member 11 to comprise the pivotal support of that end of the cam follower 12. The cam follower 12 is formed with a slipper face 12*a* on the upper side of the cam follower for engagement by the cam 13*a* at all times to maintain the cam follower 12 in this described position supported on the valve 7 and seat member 11.

As the camshaft 13 rotates in the direction of arrow 16, the cam 13*a* has a cylindrical portion that retains the valve 7 in the closed position shown in FIG. 1 and then as the lobe of cam 13*a* engages the slipper face 12*a* the cam follower 12 is pivoted downwardly to cause opening of the valve 7 in opposition to the compression spring 10. As the lobe of cam 13*a* passes the slipper face 12*a*, the cam follower 12 is pivoted upwardly by the valve 7 as resiliently urged upwardly by the compression spring 10. As thus far described, the valve actuation mechanism is of a typical construction and operation of one type of overhead valve and cam mechanism.

Figure 2:
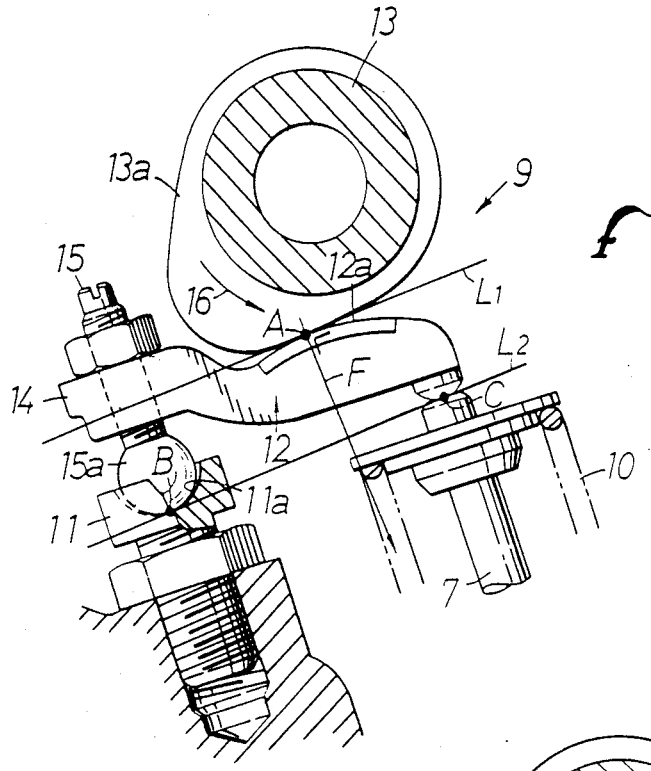
FIG. 2 is an enlarged sectional elevation view of a portion of the valve actuating mechanism of a first embodiment of this invention.

Referring now more particularly to FIG. 2, the slipper face 12*a* is so formed and shaped that the tangent line $L_1$ extending through the contact point A between the cam 13*a* and the slipper face 12*a* at the start of the valve lifting lobe of cam 13*a* is substantially parallel with a line $L_2$, extending between the contact point B between the fulcrum 15*a* and the recess 11*a* and a contact point C between the cam follower 12 and the valve 7. Thus, as the cam 13*a* starts to rotate through the valve lifting cycle the force applied by the cam 13*a* on the slipper face 12*a* is perpendicular to the lines $L_1$ and $L_2$, whereby the imposed force F does not generate or include any component of force in a lateral direction of sufficient magnitude to tend to cause lateral movement or sliding of the cam follower 12 relative to the valve 7 and seat member 11. This geometric relationship is particularly important at the start of the application of valve lifting force by the lobe of cam 13*a* since at that point in time the engagement forces are at a minimum between the cam follower 12 and seat member 11 at point B and the valve 7 at point C whereby in the prior art those forces normally are insufficient to prevent the shifting of the cam follower 12. Thus, even though inevitably there is a small degree of play or allowance between the spherical fulcrum 15*a* and the round recess 11*la* which normally allows shifting of the cam follower 12, by providing the above-described shape of the slipper face 12*a* the applied forces are geometrically balanced to avoid any tendency to cause shifting of the cam follower, as shown in FIG. 2.

Figure 3:
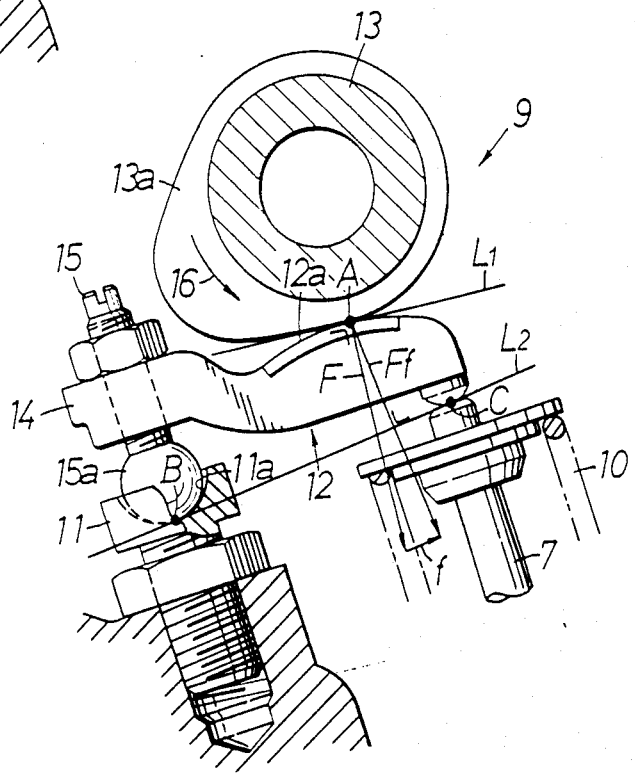
FIG. 3 is an enlarged sectional elevation view of a second embodiment of this invention.
Figure 4:
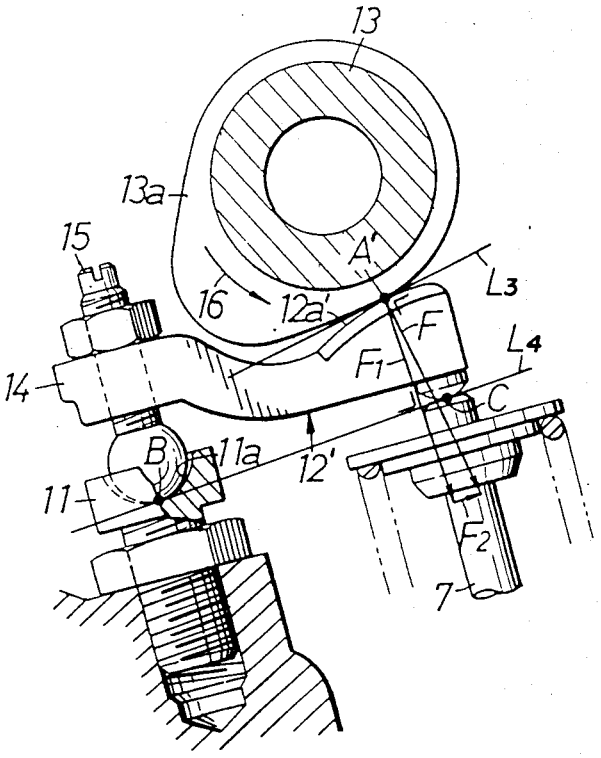
FIG. 4. PRIOR ART
FIG. 4 is an enlarged sectional elevation view of a typical prior art valve actuating mechanism for comparing the features of this invention.

However, as a practical matter, there is a frictional force developed between the rotating cam 13*a* and the slipper face 12*a* as the cam passes over the slipper face in the direction of arrow 16, which frictional force is in the lateral direction and will also tend to cause shifting of the cam follower 12 with the resultant, undesirable noise. Referring now to the second embodiment of the present invention, as illustrated in FIG. 3, the shape of the slipper face 12*a* is modified from that which is shown in FIG. 2 to tend to compensate for this additional friction force caused by the interengagement of the cam 13*a* and slipper face 12*a*. Specifically, the tangent line $L_1$ through the point A at the starting point of the lifting portion of the lobe of cam 13*a* is at a slight angle to the line $L_2$ between the points B and C previously described. Thus, assuming the frictional force is "f" between cam 13*a* and slipper face 12*a* and the lifting force is "F" directed perpendicular to line $L_1$, then the combination of those two forces produce a resultant force "Ff" which is perpendicular to the line $L_2$. Thus, by appropriately contouring the slipper face 12*a* in relation to the lobe of cam 13*a*, the frictional force f is compensated for and the resultant force Ff does not include a component of force tending to laterally shift the cam follower 12 since that resultant force is perpendicular to the line $L_2$.

In summary, according to the present invention, the slipper face of a cam follower of the type described is shaped to cause the tangent thereto at the point of contact with the cam at the start of the valve lifting cycle to be generally parallel with the line joining the contact points of the cam follower with the seat member and valve. In a second embodiment, the cam follower slipper face is formed to produce a tangent line that is slightly angled in a direction to compensate for the frictional force developed by the cam in the opposite direction on the slipper face. As a result, there are no substantial lateral forces imposed on the cam follower by the cam at the start of the valve lifting cycle which would otherwise cause lateral shifting of the cam follower and undesirable noise as has heretofore occurred in the prior art.

What is claimed:

1. A valve actuating mechanism for an overhead valve and overhead cam type internal combustion engine in which the camshaft is positioned above and between the valve and a cam follower seat member in a cylinder head of the engine, comprising, the cam follower seat member being threadedly mounted in the cylinder head and having a semi-spherical recess facing upwardly, a cam follower having an adjustable bolt threadedly received in one end of said cam follower, said adjustable bolt having a spherical fulcrum engaging the semi-spherical recess of the seat member, said cam follower also having a downwardly facing means on the other end for engaging the valve and an upwardly facing slipper face for sliding engagement with a cam on the camshaft, said cam being adapted to rotate across the slipper face in the direction of the valve, said slipper face having a surface shape for engaging the cam at the start of valve-lifting movement of said cam follower at a point through which a line tangent to said slipper face is substantially parallel to a line through contact points between said cam follower and the seat member and valve for minimizing the lateral forces imposed on said cam follower by the cam at the start of the valve-lifting movement.

2. A valve actuating mechanism for an overhead valve and overhead cam type internal combustion engine in which the camshaft is positioned above and between the valve and a cam follower seat member in a cylinder head of the engine, comprising, the cam follower seat member being threadedly mounted in the cylinder head and having a semi-spherical recess facing upwardly, a cam follower having an adjustable bolt threadedly received in one end of said cam follower, said adjustable bolt having a spherical fulcrum engaging the semi-spherical seat member, said cam follower also having a downwardly facing means on the other end for engaging the valve and an upwardly facing slipper face for sliding engagement with a cam on the camshaft, said cam being adapted to rotate across the slipper face in the direction of the valve, said slipper face having a surface shape for engaging said cam at the start of valve-lifting movement of said cam follower at a point through which a line tangent to such slipper face is at a small angle to a line through contact points between said cam follower and the seat member and valve, which angle is open in the direction opposite to the direction of movement of the cam across the slipper face for compensating for friction therebetween, for minimizing the lateral forces imposed on said cam follower by the cam at the start of the valve-lifting movement.

* * * * *